US006198215B1

(12) United States Patent
Niboshi et al.

(10) Patent No.: US 6,198,215 B1
(45) Date of Patent: Mar. 6, 2001

(54) ANTI-LIGHT-REFLECTIVE FILM, METHOD FOR MANUFACTURING THE SAME, AND EL DEVICE

(75) Inventors: Manabu Niboshi, Yamatokoriyama; Hiroyuki Shimoyama, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/048,835

(22) Filed: Mar. 27, 1998

(30) Foreign Application Priority Data

Mar. 28, 1997 (JP) ..... 9-076384

(51) Int. Cl.[7] ..... H05B 33/00

(52) U.S. Cl. ..... 313/503; 313/506; 313/112; 359/585

(58) Field of Search ..... 313/498–512, 313/112; 359/585; 430/5

(56) References Cited

U.S. PATENT DOCUMENTS 5,055,360 * 10/1991 Ogura et al. ..... 313/509
5,783,337 * 7/1998 Tzu et al. ..... 430/5
5,789,117 * 8/1998 Chen ..... 430/5
5,936,707 * 8/1999 Nguyen et al. ..... 430/5
5,952,128 * 9/1999 Isao et al. ..... 430/5

FOREIGN PATENT DOCUMENTS 0 788 297 A1 8/1997 (EP) .
61-211997 9/1986 (JP) .

OTHER PUBLICATIONS

Patent Abstracts of Japan, vol. 096, No. 012, Dec. 26, 1996 & JP 08 220522 A (A G Technol KK), Aug. 30, 1996.

* cited by examiner

*Primary Examiner*—Ashok Patel
(74) *Attorney, Agent, or Firm*—Nixon & Vanderhye PC

(57) ABSTRACT

The present invention is aimed to realize a structure which satisfies all requirements of: being free from a problem on waste water treatment in a producing process when a Cr oxide film and a Cr metal film are used, and free from a weakness in water resistance when a Mo oxide film and a Mo metal film are used; adaptability to environment; low production cost; and stability in a producing process. The structure is realized by laminating a molybdenum oxynitride film in which one substance of Si, W, Ta, and Ni is added, i.e., (Mo:X)ON(X=Si,W,Ta,Ti), and one or more metal films of Ni, Al, Mo films and the like.

6 Claims, 4 Drawing Sheets

ANTI-LIGHT-REFLECTIVE FILM, METHOD FOR MANUFACTURING THE SAME, AND EL DEVICE

BACKGROUND OF THE INVENTION

1. Field of the Invention

The present invention relates to an anti-light-reflective film which is applied to display apparatuses using an EL (electroluminescent) device or liquid crystal device and to photomasks, to a method for manufacturing the film, and to an EL device having an anti-light-reflective function.

2. Description of the Related Art

As an EL device which is used as a display apparatus for office automation or factory automation equipment, there is known an EL device having a three-layer structure as illustrated in FIG. 7. In FIG. 7, transparent strip electrodes 12 made of ITO (indium tin oxide) are patterned on a transparent substrate 10 made of glass so as to be spaced uniformly in parallel to each other. On the strip electrodes 12, a first insulating layer 13 made of an film of oxide such as $Al_2O_3$, $SiO_2$, $TiO_2$, or of nitride such as $Si_3N_4$, a luminescent layer 14 having a composition in which a very little amount of Mn or the like is added as a luminescence center to a host material of ZnS, ZnSe, SrS or the like and a second insulating layer 15 of a similar oxide or nitride film to the first insulating film 13 are laminated in this order, and then back strip electrodes 16 made of Al are patterned in a direction perpendicular to the transparent strip electrodes 12 so as to be spaced uniformly in parallel to each other.

In the thus structured EL device is realized a dot matrix display as desired, by selectively applying a voltage to the transparent electrodes 12 and the back electrodes 16, and then causing portions of the luminescent layer 14 which are at intersections of the transparent electrodes and the back electrodes to emit light in the form of dot in an arbitrary combination.

It is well known in the art that, in front of the aluminum back electrodes 16, i.e. on the side of the second insulating layer 15, an anti-light-reflective film having a laminated structure of a Cr oxide film or a Cr metal film and a laminated structure of a Mo oxide film or a Mo metal film is disposed so as to reduce the reflection of ambient light and improve the contrast ratio of display. For the purpose of absorbing the reflected light, Japanese Unexamined Patent Publication JP-A 61-211997 (1986) discloses utilization of a laminated structure of island-structure type absorbing film/transparent dielectric film/island-structure type absorbing film/metallic thin film by using an island-structure type absorbing film made of Mo, Ta, Cr, Si or the like for a back electrode film.

In the prior art structure in which the back electrodes are made of aluminum as described above, however, since the reflected light from the aluminum back electrodes is rather strong in an bright environment such as the outdoors in the daytime, the contrast ratio (on/off ratio) of display is decreased with the result that the display quality is impaired. In order to solve the problem, JP-A 61-211997 is directed to improvement of the structure of a device so that ambient light (incident light) is absorbed in the device and the intensity of reflected light to the ambient light is controlled to 10% or below.

Although in JP-A 61-211997 is used a Cr metal film for the island-structure absorbing film, the Cr metal film can be replaced with a Cr oxide film. Since in the case of an anti-light-reflective film made of a Cr oxide film or a Cr metal film, toxic dichromatic ion is generated in waste water in an etching process in patterning electrodes, disposal of the waste water in the course of processing cannot be easily conducted. Moreover, since a laminated film including an island-structure type film made of Mo, Ta, Cr, Si or the like requires two or more layers of absorbing film, the laminated film is structured by four or more layers composed of island-structure type absorbing film/transparent dielectric film/island-structure type absorbing film/metal thin film with the result that it takes time to form a laminated film and the cost increases.

An anti-light-reflective film using a Mo oxide film or a Mo metal film in place of a Cr oxide film or a Cr metal film overcomes the above problems occurring by use of a Cr oxide film or a Cr metal film, with regard to the performance, the structure, and the disposal of waste water in a producing process. However, the Mo oxide film and Mo metal film has low water resistance in the manufacturing process, and hence it is difficult to conduct an aqueous-system patterning process. According to experiments by the present inventor, a metallic film is peeled off because the Mo oxide film and Mo metal film is dissolved in a cleaning process by water.

In this way, the prior arts in which a Cr oxide film, a Cr metal film, a Mo oxide film and a Mo metal film are used have drawbacks. In the process of manufacturing a display device, especially an EL device, a structure satisfying all requirements of: being free from a problem of waste water treatment; adaptability to environment; low production cost; and stability in the manufacturing process; has not been realized.

SUMMARY OF THE INVENTION

It is hence an object of the invention to realize an anti-light-reflective film in which the above drawbacks are overcome, additionally to provide a novel structure of an anti-light-reflective film in which high contrast is realized, and to provide a method for producing the film and an EL device using the film.

The anti-light-reflective film of the invention is featured by a two-layer structure composed of (Mo:X)ON and a metal film. The EL device of the invention is featured by utilizing the anti-light-reflective film. In particular, the method for manufacturing the EL device is featured by controlling the refractive index and thickness of (Mo:X)ON film.

In a first aspect of the invention, an anti-light-reflective film comprises:

a molybdenum oxynitride ((Mo:X)ON(X=Si,W,Ta or Ni)) film including any one of Si, W, Ta and Ni, and one or more metal films selected from among Ni, Al and Mo films, the films forming a laminated structure.

According to the first aspect of the invention, an anti-light-reflective film of two layer structure type is realized which has high water resistance, and is free of a problem of waste water treatment in a patterning process.

In a second aspect of the invention, the anti-light-reflective film of the first aspect of the invention is characterized in that the molybdenum oxynitride film is selected to have a refractive index in a range of 2.2 to 2.8 and to have a thickness in a range of 30 nm to 60 nm; and the metal film is selected to have a thickness in a range of 300 nm to 600 nm.

In a third aspect of the invention, the anti-light-reflective film of the second aspect of the invention is characterized in that the molybdenum oxynitride film is selected to have a refractive index in a range of 2.4 to 2.6 and to have a thickness of 40 nm to 50 nm.

In a fourth aspect of the invention, the anti-light-reflective film of the third aspect of the invention is characterized in that the molybdenum oxynitride film is selected to have a refractive index of 2.4 and to have a thickness of 50 nm.

According to the second aspect of the invention, the intensity of reflected light can be sufficiently suppressed. According to the third aspect of the invention, the intensity of reflected light can be more sufficiently suppressed. According to the fourth aspect of the invention, the intensity of reflected light can be most sufficiently suppressed.

In a fifth aspect of the invention, a method for producing an anti-light-reflective film comprising a molybdenum oxynitride ((Mo:X)ON(X=Si,W,Ta or Ni)) film including any one of Si, W, Ta and Ni, and any one or more metal films of Ni, Al and Mo films, the films forming a laminated structure, the method comprising a step of forming the molybdenum oxynitride film by sputtering in which a flow rate of oxygen is set in a range of 2 ccm to 4 ccm.

According to the fifth aspect of the invention, determining the flow rate of oxygen in sputtering as described above enables to form an anti-light-reflective film which can sufficiently suppress the intensity of reflected light as described above.

According to the anti-light-reflective film and method for manufacturing the same, it is possible to manufacture an anti-light-reflective film which has as superior a performance in reducing reflection of light as a Cr oxide film and a Cr metal film which have been conventionally used, which does not require any special processing as conventionally required in the course of disposal of Cr waste water after etching and so on, and which has high water resistance and chemical resistance in the manufacturing process.

In a sixth aspect of the invention, an EL device comprises: transparent electrodes patterned on a light transmitting substrate; a first insulating layer, an EL luminescent layer and a second insulating layer which are formed in this order on the light transmitting substrate with covering the transparent electrodes; and back electrodes patterned on the second insulating layer.

wherein the back electrodes include molybdenum oxynitride ((Mo:X)ON(X=Si,W,Ta or Ni)) film having one of Si, W, Ta and Ni, disposed on the second insulating layer; and any one or more metal films of Ni, Al and Mo films, disposed on the molybdenum oxynitride film.

According to the sixth aspect of the invention, the reflection of ambient light is reduced, whereby the quality of display can be improved.

In a seventh aspect of the invention, the EL device of the sixth aspect of the invention is characterized in that the molybdenum oxynitride film is selected to have a refractive index in a range of 2.2 to 2.8 and to have a thickness in a range of 30 nm to 60 nm; and the metal film is selected to have a thickness in a range of 300 nm to 600 nm.

In an eighth aspect of the invention, the EL device of the seventh aspect of the invention is characterized in that the molybdenum oxynitride film is selected to have a refractive index in a range of 2.4 to 2.6 and to have a thickness in a range of 40 nm to 50 nm.

In a ninth aspect of the invention, the EL device of the eighth aspect of the invention is characterized in that the molybdenum oxynitride film is selected to have a refractive index of 2.4 and to have a thickness of 50 nm.

According to the seventh aspect of the invention, an EL device which can sufficiently suppress the intensity of reflected light is obtained. According to the eighth aspect of the invention, an EL device which can more sufficiently suppress the intensity of reflected light is obtained. According to the ninth aspect of the invention, an EL device which can most sufficiently suppress the intensity of reflected light is obtained.

The EL device of the invention enables to reduce the reflection of ambient light thereby improving the display quality. The manufacturing method enables to manufacture EL devices with good reproducibility in quantity and at low cost. Furthermore, in a display device such as an EL device, by adjusting physical values (refractive index and thickness) of a film and applying a two-layer structure, the contrast ratio of the display device can be improved. By controlling the refractive index and thickness of the film when forming the film, the device can be manufactured with good reproducibility in quantity and at low cost.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
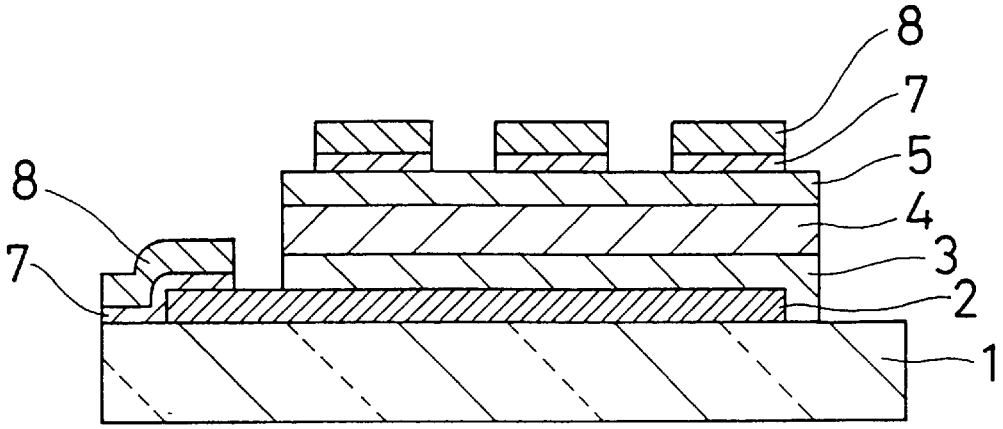
FIG. 1 is a sectional view showing the structure of an EL device of an embodiment of the invention.

Now referring to the drawings, preferred embodiments of the invention are described below.

FIG. 1 is a sectional view showing a structure of an EL device having an anti-light-reflective function according to an embodiment of the invention. The EL device comprises a light transmitting substrate 1, transparent electrodes 2 patterned on the light transmitting substrate 1, a first insulating layer 3 formed on the light transmitting substrate 1 so as to cover almost the whole of the transparent electrodes 2, an EL layer 4 formed on the first insulating layer 3, a second insulating layer 5 formed on the EL layer 4, a Mo oxynitride film 7 formed on the second insulating layer 5, and a metal film 8 formed on the Mo oxynitride film 7.

The light transmitting substrate 1 is made of glass, for example. The transparent electrodes 2 are made of ITO (indium tin oxide), for example, and are patterned into parallel strips spaced from each other at regular intervals. The first insulating layer 3 is formed of an oxide film such as $Al_2O_3$, $SiO_2$ and $TiO_2$ films, or a nitride film such as $Si_3N_4$ film. The EL layer 4 has such a constitution that a trace quantity of Mn or the like is added as a luminescence center to a host material of ZnS, ZnSe or SrS. The second insulating layer 5 is formed of the same oxide or nitride film as that of the first insulating layer 3. The molybdenum oxynitride film 7 and the metal film 8 are patterned so as to form strips spaced in parallel to each other at regular intervals in a direction orthogonal to the transparent electrodes 2. The Mo oxynitride film 7 is a film including any one of Si, W, Ta and Ni, and also represented by a (Mo:X) ON (X=Si, W, Ta, or Ni) film. The metal film 8 is a film which comprises one or more of Ni, Al and Mo films.

By interposing the molybdenum oxynitride film 7 between the second insulating layer 5 and the metal film 8, it becomes possible to suppress the light mirror reflection intensity of the metal film 8 viewed from the light transmitting substrate 1 side. The molybedenum oxynitride film 7 is a (Mo:Si)ON film in this embodiment, and is prepared using a reactive DC sputtering method at a sputtering output of 1.8 kW by introducing 0 cc to 12 cc of $O_2$ gas, Mo-Si as a target and 200 ccm of $N_2$ gas.

Figure 2:
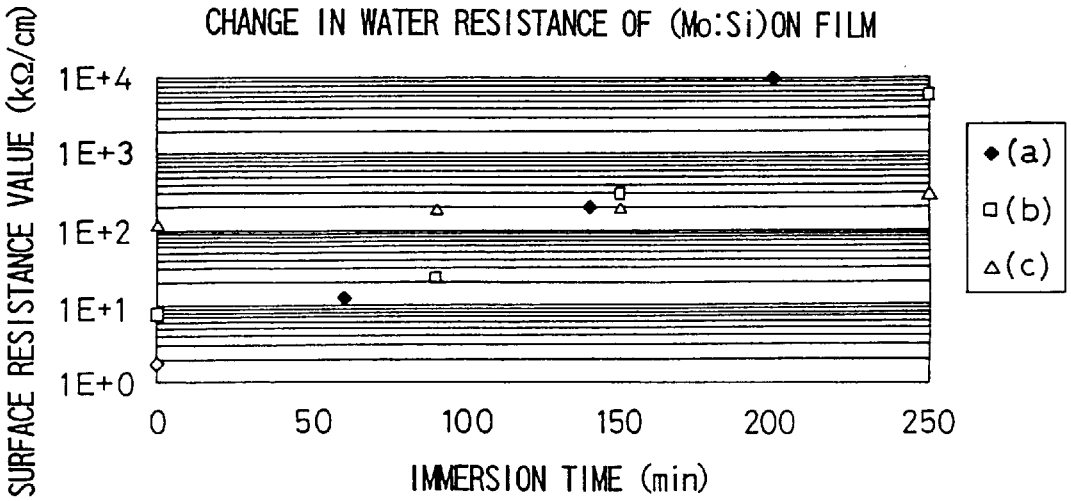
FIG. 2 is a graph showing the relationship of resistance values of a surface of a(Mo:Si)ON film to immersion times.

The water resistance of the (Mo:Si)ON film according to the invention and reflection characteristics of the (Mo:Si)ON film including the metal film, change depending on the amount of Si to be added, composition ratios of both elements, and film thickness. At first, the water resistances were examined for samples (a), (b), and (c) in which (Mo:Si)ON films are formed on glass substrates. FIG. 2 shows water resistance examined by varying Si contents in the (Mo: Si)ON films. The horizontal axis of the graph represents a time (min) during which the (Mo:Si)ON film is immersed in hot water (60° C.), and the vertical axis of the graph represents surface resistance values (Ω/cm). The water resistance was examined by using the fact that decrease in water resistance causes a surface of the film to be dissolved as the immersion time is elapsed, so that the resistance value increases. The samples (a) through (c) in the graph are as follows: the sample (a) is a molybdenum nitride film sample without adding Si ($MoN_x$), the sample (b) is a film sample formed by using a target of Si/Mo=0.7, and the sample (c) is a film sample formed by using a target of Si/Mo=1.2. The composition ratios of the formed films of the samples (a), (b), and (c) are shown in Table 1.

TABLE 1

| Sample Name | Mo (at %) | Si (at %) | else(NO) |
|---|---|---|---|
| (a) | 49 | 0 | 51 |
| (b) | 33 | 18 | 49 |
| (c) | 26 | 24 | 50 |

From the above results, it is found that addition of Si as seen in the samples (b) and (c) is preferable with respect to the water resistance, namely the water resistance is improved, but etching property is reduced as the amount of Si increases.

Figure 3:
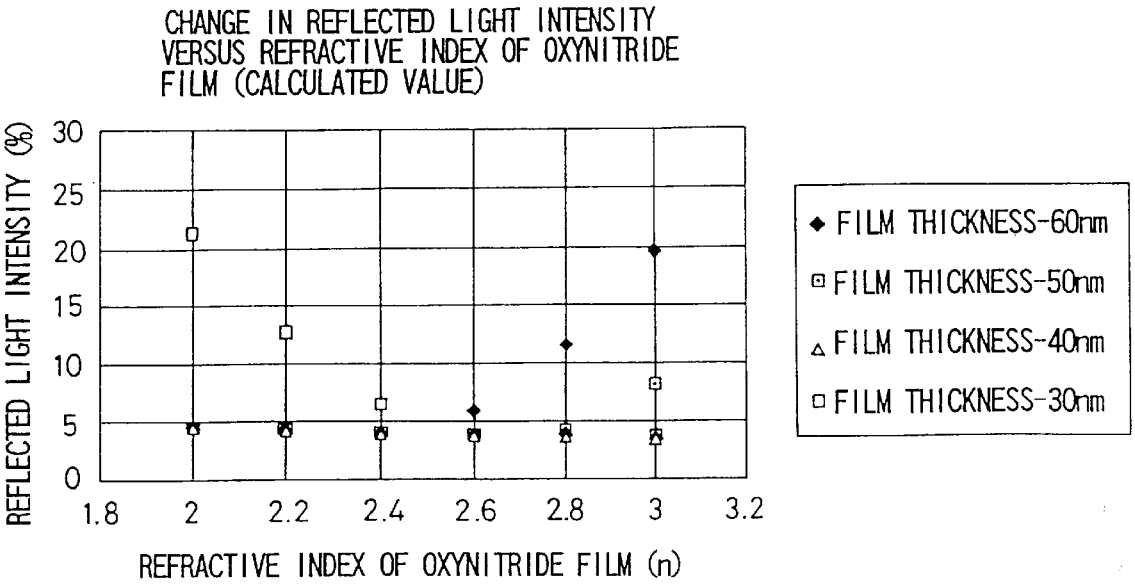
FIG. 3 is a graph showing intensities of reflected light (calculated values) with respect to a refractive index for every thickness of (Mo:Si)ON films.

FIG. 3 shows results of an optical simulation for obtaining reflected light characteristics which would be taken out from a glass surface, when a Mo:X oxynitride film is formed on the glass without coating on its surface and a Ni film is formed on the Mo:X oxynitride film. From the above-mentioned samples (a) through (c), samples are prepared in which a Ni film has a thickness of 350 nm and a bulk value represented by refractive index and absorption coefficient is constant, a (Mo:X)ON film has a refractive index in a range of 1.8 to 3.2 and the film thickness is varied among 30 nm, 40 nm, 50 nm, and 60 nm. For the samples thus prepared, reflected light characteristics with respect to the incident light were calculated in a geometrical optical manner for objective wavelengths in the range from 400 nm to 700 nm at 10 nm intervals. In regard to the incident light within the wavelength range of 400 nm to 700 nm, a minimum value of the relative ratio of the reflected light characteristics of an Al film with respect to the calculated reflected light characteristics is defined as reflected light intensity (%). The Al film has a thickness of 200 nm or more, for example, in which approximately equal reflectance can be obtained for the entire wavelength range of 400 nm to 700 nm. The reflected light intensities are plotted on the vertical axis of the graph in FIG. 3 as an indicator of the anti-light-reflective performance. The refractive indices of the oxynitride film used in calculating the reflected light characteristics are plotted on the horizontal axis of this graph. The relationships between the reflected light intensities and the refractive indices are shown for the respective thicknesses of the oxynitride films. It is thus expected that a reflected light intensity of 10% or less equivalent to that of the layered structure of a Cr oxide film and a Cr metal film conventionally used as a black electrode is obtained, when a thickness of 30 nm or more is selected as the thickness of the (Mo:X)ON film having a refractive index in the range from 2.2 to 2.8.

Figure 4:
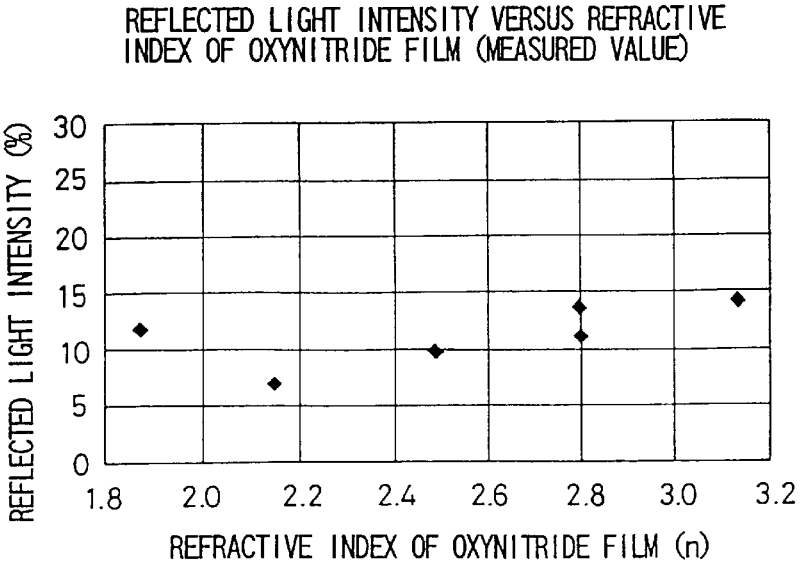
FIG. 4 is a graph showing the intensity of reflected light (measured value) with respect to refractive index for every thickness of (Mo:Si)ON films.

Sample series established by the simulation analysis in FIG. 3 were prepared, and FIG. 4 shows examination results of the refractive index of the oxynitride film and the reflected light characteristics of each sample. A sample having a reflected light intensity of 10% or less at a refractive index within the range from 2.2 to 2.8 could be prepared, and this result coincides with the simulation result of FIG. 3. (In this case, the film thickness was set at 30 nm or more.)

Figure 5:
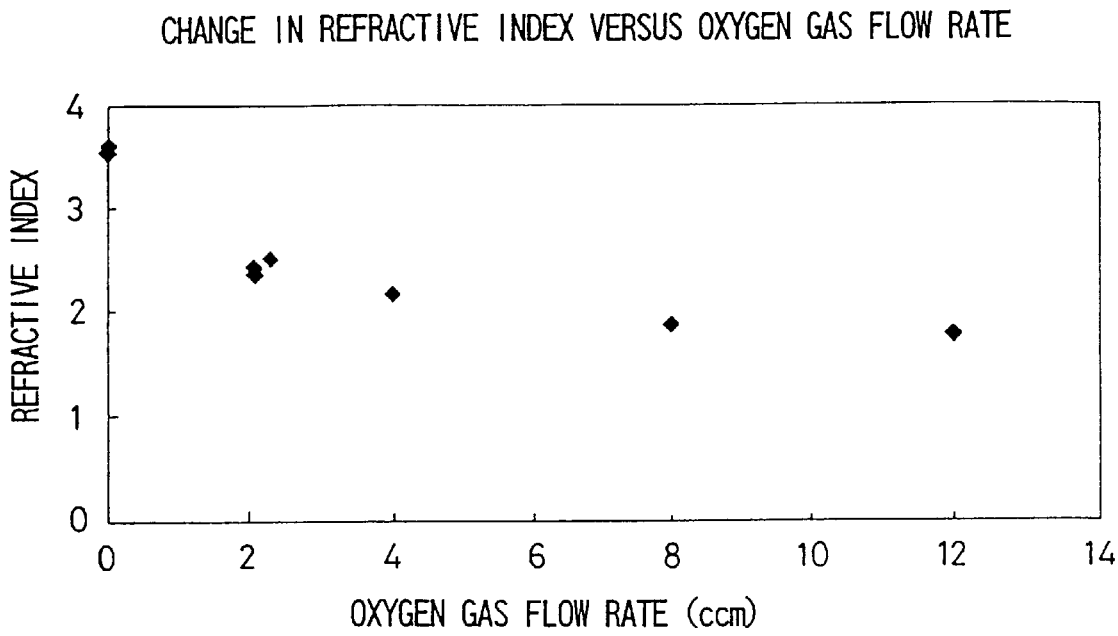
FIG. 5 is a graph showing the relationship between $O_2$ gas flow rates in forming (Mo:Si)ON films by sputtering and refractive indices of the films.

For preparing the anti-light-reflective film of the invention, a (Mo:Si)ON film was examined with respect to change in refractive index to oxygen flow rate in forming the (Mo:Si)ON film (FIG. 5). It is found that a anti-light-reflective film in which the refractive index of the (Mo:Si) ON film is within the range from 2.2 to 2.8 can be obtained at an oxygen flow rate of 2 ccm to 4 ccm.

Figure 6:
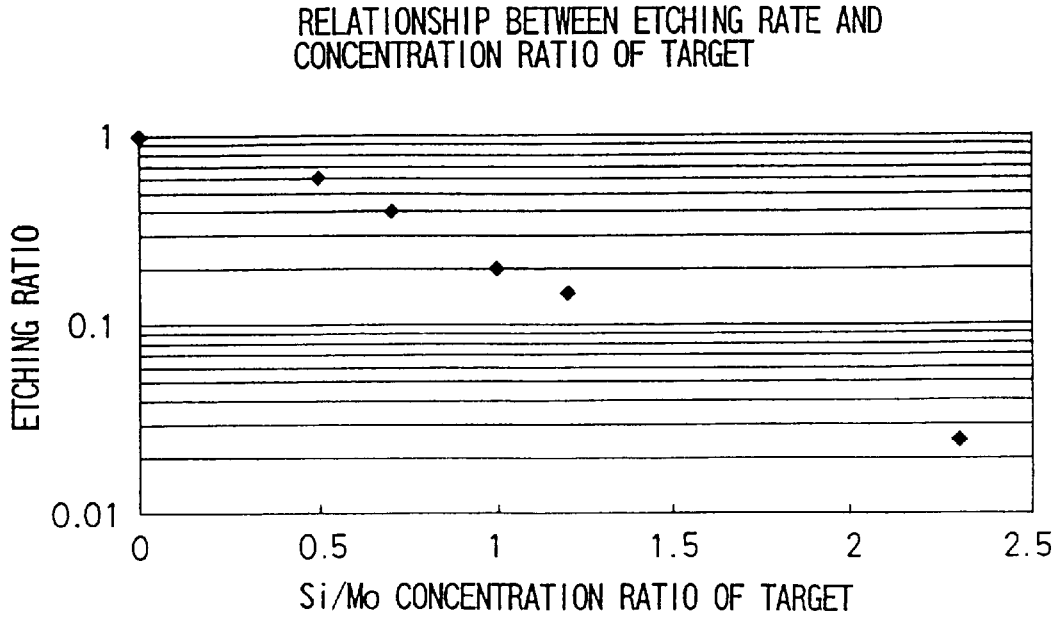
FIG. 6 is a graph showing the relationship between Si/Mo concentration ratios in a target and etching rates of (Mo:Si) ON films formed on the target.
Figure 7:
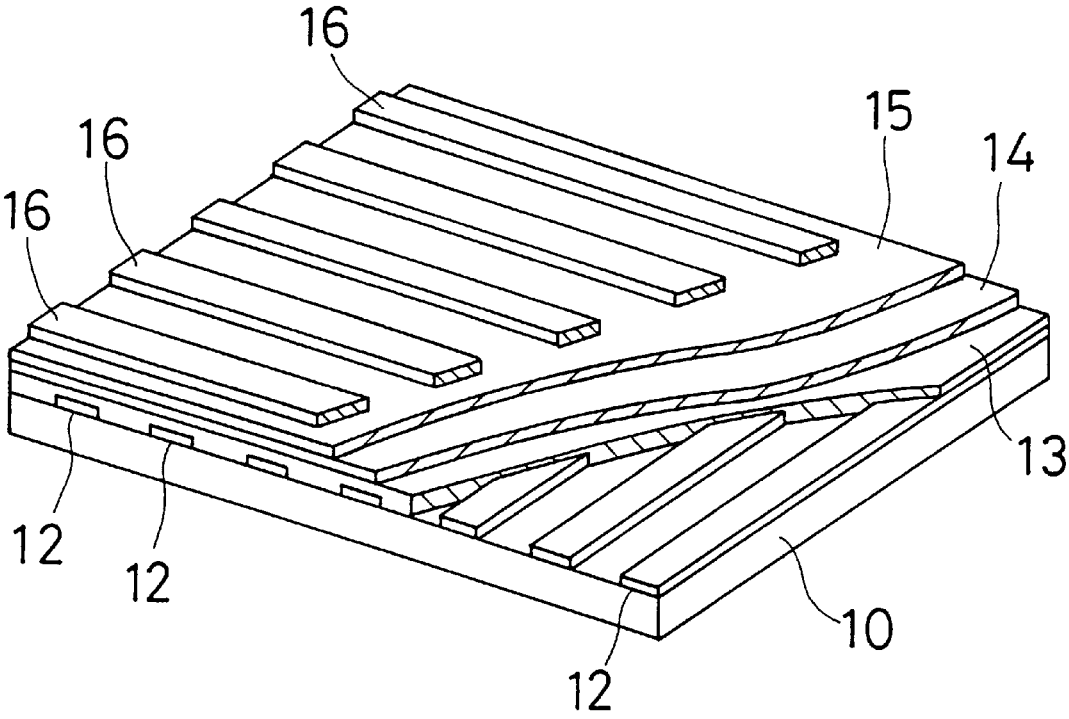
FIG. 7 PRIOR ART
FIG. 7 is a partially sectional perspective view of a conventional EL device.

FIG. 6 shows the relationship between Si/Mo concentration ratios of a target, and etching rates of a (Mo:Si)ON film formed by using the target. As seen from FIG. 6, as an introduction ratio of Si/Mo of the target are preferable a Si/Mo concentration ratio of 0.5 from aspect of the water resistance and a Si/Mo concentration ratio of 1 or less from aspect of the etching property. In this embodiment, explanation was made for the case in which Si is used as an additive, but also other additives such as W, Ta, Ni may be effective for improving the water resistance.

Further, from FIG. 4 it can be summarized as in Table 2 with respect to the reflected light characteristics.

TABLE 2

| thickness of | refractive indices of (Mo:Si) ON film | | | | | |
|---|---|---|---|---|---|---|
| (Mo:Si)ON film | 2.0 | 2.2 | 2.4 | 2.6 | 2.8 | 3.0 |
| 30 nm | X | Δ | ○ | ○ | ○ | ○ |
| 40 nm | ○ | ○ | ○ | ○ | ○ | ○ |
| 50 nm | ○ | ○ | ○ | ○ | ○ | ○ |
| 60 nm | ○ | ○ | ○ | ○ | Δ | X |

comparison of reflected light intensities depending on changes in refractive index and film thickness of (Mo:Si) ON film.

Specifically, the (Mo:Si)ON film preferably has a refractive index within the range from 2.2 to 2.8 at a film thickness of 30 nm to 60 nm, more preferably has a refractive index within the range from 2.4 to 2.6 at a film thickness of 40 nm to 50 nm, and most preferably has a refractive index of 2.4 at a film thickness of 50 nm. In this description, explanation was made for the case of using Si as the additive, but similar results can be obtained also in the case of using other additives (W, Ta, Ni).

Next, a method of manufacturing the anti-light-reflective film of the invention in the case of applying the same in an EL device will be explained.

Parallel transparent strip electrodes 2 made of ITO are patterned on the light transmitting substrate 1 made of glass or the like so as to be spaced from each other, and thereon are laminated the first insulating layer 3 composed of an oxide film such as an $Al_2O_3$, $SiO_2$ or $TiO_2$ film, or of a nitride film such as a $Si_3N_4$ film, the luminescent layer 4 having such a composition that a trace quantity of Mn or the like is added as a luminescence center to a host material such as ZnS, ZnSe or SrS, and the second insulating layer 5 composed of the above-mentioned oxide or the nitride film in this order.

Further, on the second insulating layer 5 is layered a (Mo:Si)ON film having a thickness of 30 to 60 nm as the molybdenum oxynitride film 7 while controlling the oxygen gas flow rate in the range from 2 to 4 ccm so that the molybdenum oxynitride film 7 has a refractive index within the range from 2.2 to 2.8. And then, a Ni film as the metal layer 8 is layered so as to have a thickness of 300 nm to 600 nm. These electrode films of the (Mo:Si)ON film and the Ni film are patterned so as to have a predetermined shape.

More specifically, on these electrode films, a photoresist pattern for back electrodes and a photoresist pattern for terminal electrodes are formed in a form of parallel strips spaced from each other in a direction orthogonal to the transparent electrode. Then the Ni film is etched with a mixed solution of phosphoric acid and nitric acid (4:1 to 5:1, 30 to 60% dilution) and washed. After that, the (Mo:Si)ON film is etched with a mixed solution of cerium ammonium nitrate and perchloric acid (4:1 to 5:1, 60 to 80% dilution) without removing the photoresist patterns, and after washing, the photoresist patterns are removed to thereby form back electrodes and terminal electrodes. It is also possible to remove the two layered films at the same time by using only the mixed solution of phosphoric acid and nitric acid mentioned above. In this way, the molybdenum oxynitride film 7 and the metal film 8 are formed into predetermined shapes. These films 7 and 8 constitute so-called back electrodes.

In this embodiment, though explanation was made for the case where the molybdenum oxynitride film is used as a part of the back electrode of the EL device, the molybdenum oxynitride film may also be applied to a black matrix used for a color filter in a color liquid crystal display panel and to a photomask used in a photo process. When the molybdenum oxynitride film is applied to the liquid crystal display panel or the photomask, the molybdenum oxynitride film may be formed on the transparent electrode, and then a film of Ni, Al, Mo or the like may be layered on the Mo oxynitride film as in the above embodiment, in order to prevent the reflection viewed from the side of the transparent substrate made of glass or the like. Further, in order to prevent the reflection viewed from the film surface side, a metal film of Ni, Al, Mo or the like regardless of whether it is transparent or opaque may be formed on the substrate, and thereon may be layered the molybdenum oxynitride film.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An anti-light-reflective film comprising:

a molybdenum oxynitride film including any one of Si, W, Ta and Ni, and at least one metal film selected from the group consisting of Ni, Al and Mo films, wherein the molybdenum oxynitride film and said at least one metal film form a laminated structure, and further wherein the molybdenum oxynitride film is selected to have a refractive index in a range of 2.2 to 2.8 and to have a thickness in a range of 30 nm to 60 nm; and the metal film is selected to have a thickness in a range of 300 nm to 600 nm.

2. The anti-light-reflective film of claim 1, wherein the molybdenum oxynitride film is selected to have a refractive index in a range of 2.4 to 2.6 and to have a thickness of 40 nm to 50 nm.

3. The anti-light-reflective film of claim 2, wherein the molybdenum oxynitride film is selected to have a refractive index of 2.4 and to have a thickness of 50 nm.

4. An electroluminescent device comprising transparent electrodes patterned on a light transmitting substrate; a first insulating layer, an electroluminescent layer and a second insulating layer which are formed in this order on the light transmitting substrate and covering the transparent electrodes; and back electrodes patterned on the second insulating layer, wherein the back electrodes include a molybdenum oxnitride film having one of Si, W, Ta and Ni, disposed on the second insulating layer; and at least one metal film selected from the group consisting of Ni, Al and Mo films, disposed on the molybdenum oxynitride film, and further wherein the molybdenum oxynitride film is selected to have a refractive index in a range of 2.2 to 2.8 and to have a thickness in a range of 30 nm to 60 nm; and the metal film is selected to have a thickness in a range of 300 nm to 600 nm.

5. The electroluminescent device of claim 4, wherein the molybdenum oxynitride film is selected to have a refractive index in a range of 2.4 to 2.6 and to have a thickness in a range of 40 nm to 50 nm.

6. The electroluminescent device of claim 5, wherein the molybdenum oxynitride film is selected to have a refractive index of 2.4 and to have a thickness of 50 nm.

* * * * *